US006536146B2

(12) United States Patent
Ericson

(10) Patent No.: US 6,536,146 B2
(45) Date of Patent: Mar. 25, 2003

(54) MOVEMENT EFFECT VISUAL DISPLAY

(76) Inventor: Steven Ericson, 1742 W. Maple Ave., Langhorne, PA (US) 19047

( * ) Notice: Subject to any disclaimer, the term of this patent is extended or adjusted under 35 U.S.C. 154(b) by 0 days.

(21) Appl. No.: 09/864,233

(22) Filed: May 25, 2001

(65) Prior Publication Data

US 2002/0174580 A1 Nov. 28, 2002

(51) Int. Cl.[7] ..... G09F 19/14

(52) U.S. Cl. ..... 40/453; 40/738; 40/743; 359/478; 359/804

(58) Field of Search ..... 40/453, 738, 743, 40/454; 359/478, 807, 804

(56) References Cited

U.S. PATENT DOCUMENTS

| | | | | | |
|---|---|---|---|---|---|
| 1,742,378 | A | * | 1/1930 | Boese | 40/738 |
| 2,268,351 | A | | 12/1941 | Tanaka | |
| 2,565,553 | A | * | 8/1951 | Foley | 428/12 |
| 2,888,855 | A | | 6/1959 | Tanaka | |
| 2,968,108 | A | | 1/1961 | Knox | |
| 2,971,282 | A | * | 2/1961 | Petrey | 40/738 |
| 3,041,762 | A | * | 7/1962 | Knox | 40/738 |
| 3,053,135 | A | | 9/1962 | Tanaka | |
| 3,237,332 | A | * | 3/1966 | Petrey | 40/738 |
| 3,333,358 | A | * | 8/1967 | Green et al. | 40/738 |
| 3,596,391 | A | * | 8/1971 | Knight, Jr. | 40/720 |
| 3,597,042 | A | | 8/1971 | Favre | |
| 3,694,648 | A | * | 9/1972 | Yates | 362/311 |
| 3,701,581 | A | | 10/1972 | Henkes, Jr. | |
| 3,715,823 | A | * | 2/1973 | Brossard | 40/743 |
| 4,040,724 | A | * | 8/1977 | Klingler | 359/804 |
| 4,805,680 | A | * | 2/1989 | Ueno | 150/147 |
| 5,265,357 | A | * | 11/1993 | Yu | 362/31 |
| 5,419,063 | A | * | 5/1995 | Lane | 40/746 |
| 5,471,347 | A | * | 11/1995 | Galiani | 359/807 |
| 5,617,663 | A | | 4/1997 | Miki et al. | |
| 5,713,147 | A | * | 2/1998 | Johnson | 40/734 |
| 6,055,115 | A | * | 4/2000 | Davis | 359/800 |
| 6,226,907 | B1 | * | 5/2001 | Conley et al. | 40/454 |
| 6,263,604 | B1 | * | 7/2001 | Williams | 40/718 |

* cited by examiner

*Primary Examiner*—William L. Miller
(74) *Attorney, Agent, or Firm*—Dowell & Dowell, P.C.

(57) ABSTRACT

An assembly for displaying pictures, photographs, painting, drawings and similar articles which includes a frame supporting the article so as to be concavely oriented along a central vertical axis toward a front of the frame housing and wherein a compound lens system is mounted forwardly of the article having a first picture glass surface having a plurality of non-uniform distortions provided therein which function as a plurality of miniature lenses and wherein an opposite surface of the compound lens system includes a magnification lens oriented on a line extending transversely to the central vertical axis such that images viewed through the frame are given the illusion of movement.

6 Claims, 4 Drawing Sheets

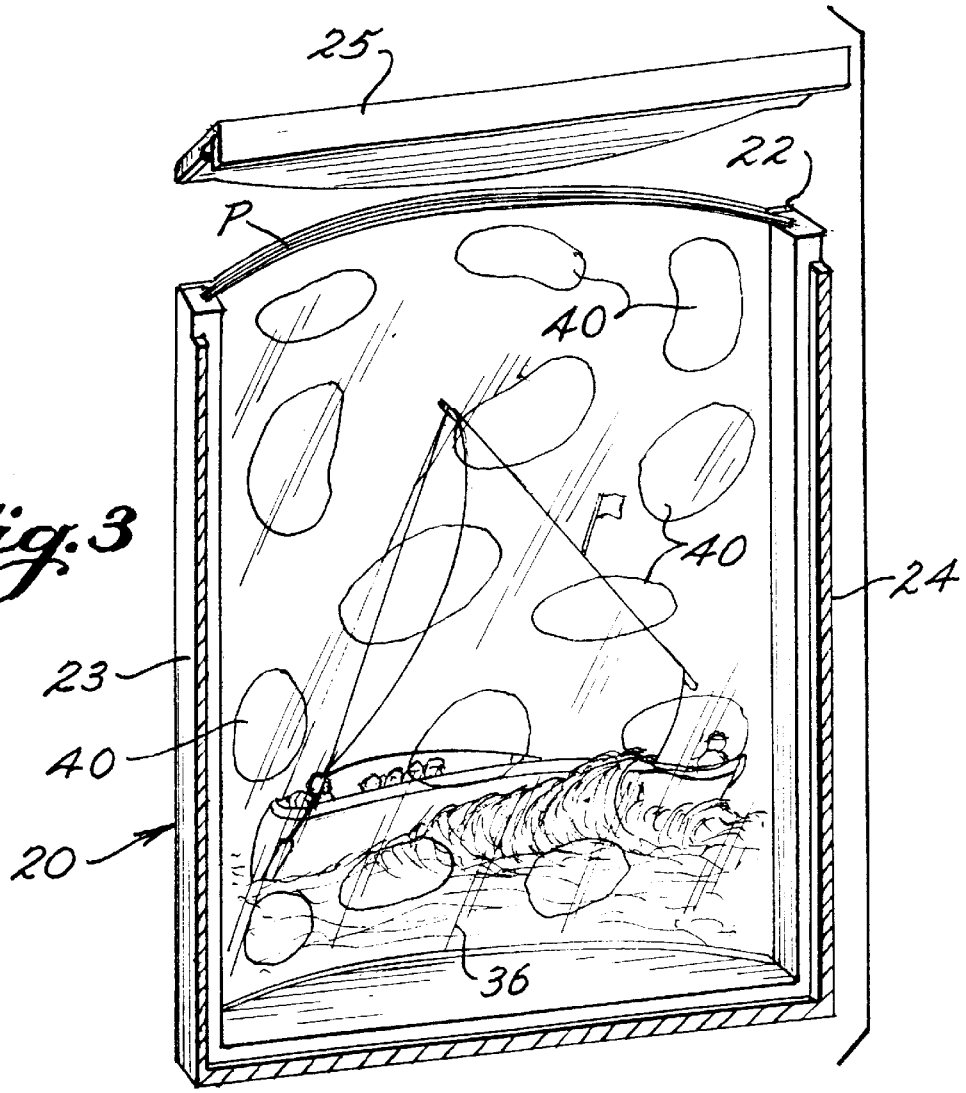
Fig. 3
Fig. 4
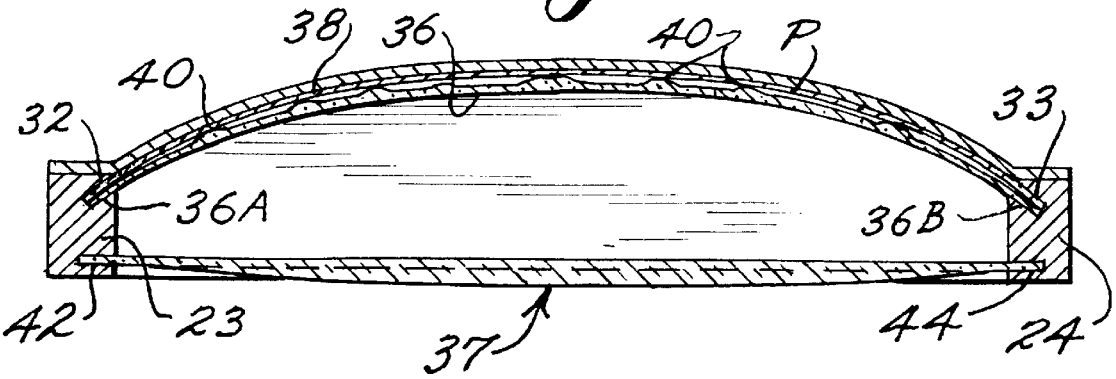

Fig. 5
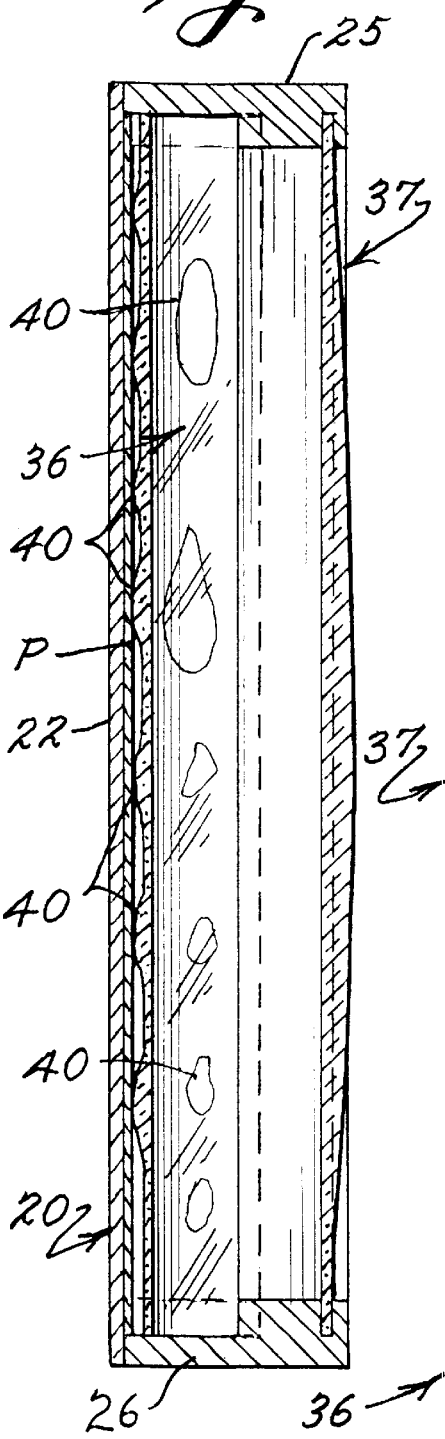
Fig. 6
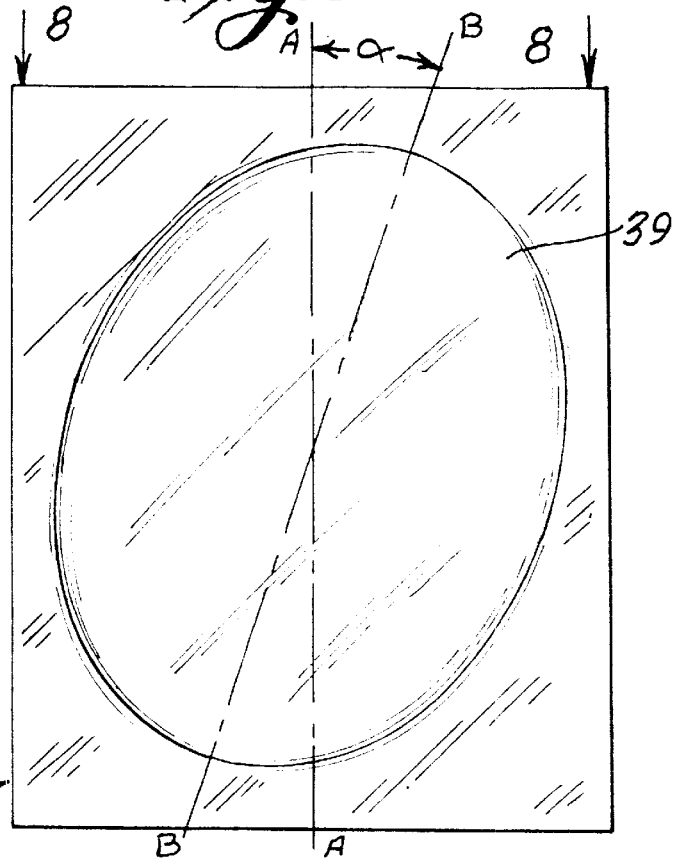
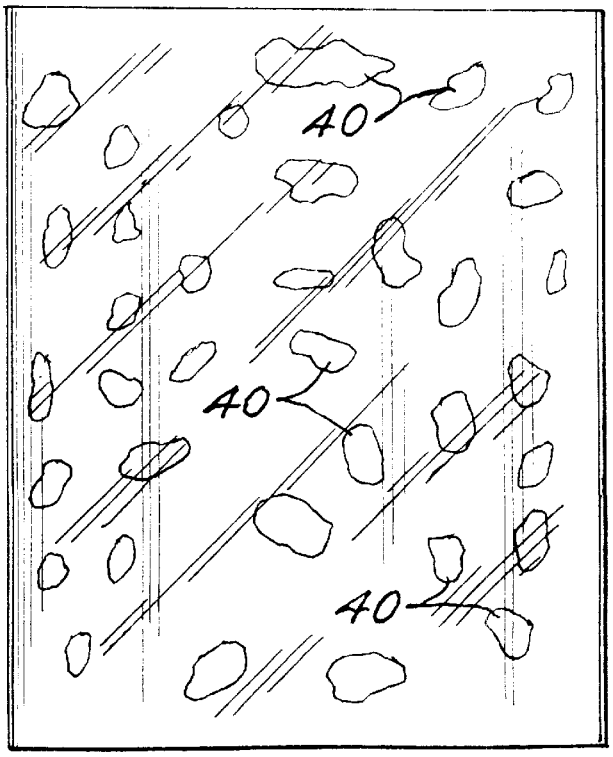
Fig. 7

MOVEMENT EFFECT VISUAL DISPLAY

BACKGROUND OF THE INVENTION

1. Field of the Invention

This invention is generally directed to display devices such as picture frames and photograph frames which are particularly constructed in order to create a perceived motion to an article being displayed and for creating a three-dimensional viewing effect for a photograph, picture, painting, drawing, embroidery or other article being displayed. More particularly, the present invention is directed to display devices including picture or photographic frames which utilize a compound lens system for distorting and magnifying portions of images when viewed.

2. Brief Discussion of the Related Art

In order to display pictures and photographs and other generally two-dimensional objects, in a more realistic and life-like manner, there have been various innovations with respect to creating picture frames and similar devices which are specifically configured to create an illusion of depth, such as creating a three-dimensional display of an otherwise two-dimensional object or to otherwise enhance a display which is static. By way of example, in U.S. Pat. No. 2,968,108 to Knox, a pictorial display device is disclosed including a display frame having components which support a picture or photograph in such a manner that the surface is semi-cylindrically presented in an arc configuration with the center axis of the picture extending closer to the front of the frame than the sides. This type of mounting gives an illusion that portions of the picture are spaced at different distances from a viewer, thus, giving a three-dimensional effect to the article being displayed. Although some three-dimensional effects may be created, the article being displayed remains static when viewed from a viewing direction.

In U.S. Pat. No. 3,701,581 to Henkes, Jr., a stereoscopic enhancement for pictorial displays is disclosed wherein a two-dimensional display is mounted within a stereographic frame. The frame includes surfaces for decreasing scene brightness in a non-linear manner such that the picture becomes disassociated with respect to the frame, whereby causing a three-dimensional effect.

In U.S. Pat No. 5,617,663 to Miki et al., a three-dimensional photographic display is disclosed which uses a co-linear support similar to that disclosed in the aforementioned patent to Knox. However, in order to create a greater three-dimensional effect, mirrored surfaces are provided on the lateral sides of the support for the photograph.

In U.S. Pat. No. 3,597,042 to Favre, a display device for creating an apparent three-dimensional effect is disclosed which includes a lens system which incorporates a planar surface facing a picture which surface is covered by a plurality of opaque strips or stripes. The lens has a plurality of undulated faces on the opposite side thereof. In this manner, a plurality of generally parallel lenses are created having an optical center between the flat surface of the lens and the undulated outer surface with the lenses being separated by the opaque stripes provided on the flat surface. A somewhat similar lens system for creating an apparent three-dimensional effect utilizing a plurality of undulated surfaces on a lens system is disclosed in the U.S. Pat No. 2,268,351 to Tanaka.

In U.S. Pat No. 3,053,135 to Tanaka, a compound lens systems is disclosed which includes interfacing undulated lens which are mounted in face-to-face relationship forwardly of a picture. The interface between the lenses causes a viewer's left and right eyes to perceive the picture in several different planes thereby creating a three-dimensional effect.

The foregoing innovations have been made in order to create a depth illusion with respect to the presentation of a two-dimensional object such as a photograph or picture. However, the innovations do not further concern making elements of a picture or article being displayed appear to exhibit slight movement. In view of the foregoing, there remains a need to provide for display systems which not only create a three-dimensional effect but also create an illusion of object movement with respect to a static two-dimensional display.

SUMMARY OF THE INVENTION

The present invention is directed to a display assembly for two-dimensional objects or articles such as photographs, pictures, paintings and the like which both creates a perception of depth to a viewer and also creates a simulation of motion of elements of the articles being displayed. The invention includes a frame housing having a front, rear and opposite sides. An article support member is provided within the housing and is arcuate or semi-cylindrical in configuration such articles, such as pictures, when mounted therein, are caused to be curved about a central vertical axis of the housing in a manner such that the article is concave along the vertical axis toward the front of the housing. Mounted forwardly of the article support portion is a compound lens system which is specifically configured to create minor distortions of the image being viewed and also to magnify at least portions of the image with the magnifying lens being ellipsoidal in shape and offset, in a preferred embodiment, so that its major axis transverse with respect to the central vertical axis of the housing.

In a preferred embodiment, the distortions in the image are created by texturing the surface of a sheet of picture glass or plastic so as to make slight changes in the thickness. Such texturing is made along a surface of the picture glass or plastic which faces the article being displayed. The texturing is done in order to provide a plurality of non-uniform end spaced bump-like distortions which function as miniature lenses. In this respect, the miniature lenses have a somewhat convex surface opposing the two-dimensional article. In a preferred embodiment, the picture glass or plastic is curved to complement the curvature of the article when it is mounted within the frame housing. The size of the miniature lenses may vary and will depend upon the overall size of the frame housing. It is preferred that the lenses be relatively small and/or weak, such that no obvious distortions of overall images of the article being displayed are distorted and only portions of such images are slightly distorted when being viewed.

To further create an illusion of depth and motion, the compound lens system also includes a magnification lens, which in the preferred embodiment, is formed by a lens of substantially the same size as an opening defined by the front of the frame housing and which includes a generally flat inner surface and a very slightly somewhat convex outer surface. In the preferred embodiment, the lens is formed in somewhat elliptical configuration with the major axis of the ellipse being oriented on a line which is somewhat diagonal or transverse with respect to the central vertical axis of the housing and thus, also, the image of the article being displayed. A combination of the miniature distortion lenses caused by the texturing of the picture glass or plastic together with the magnification of the elliptical lens creates both a sense of depth and of motion of the image being viewed.

As an alternate embodiment of the invention, the textured distortion picture glass or miniature lenses created on the picture glass may be integrally formed with the magnifying lens. When this is done, the overall lens, which may be formed of glass or plastic, will include a front magnifying lens surface which is substantially planar with the exception of the small amount of convex surface with the rear surface being arcuately curved to complement the curvature for the article being displayed. The outer surface of the arcuate portion of the combination lens is textured in the manner discussed above with respect to creating miniature distortion.

It is the primary object of the present invention to provide displays in the form of frames for pictures, photographs, paintings and the like which may be either mounted to a wall or supported on a horizontal surface and wherein an article to be displayed is housed in such a manner as to create both an illusion of three-dimensional relief and to create an illusion of motion of elements of the article being displayed.

It is a further object of the present invention to provide a display for two-dimensional objects which allows the image of the object to be presented to a viewer in such a manner that the viewer believes that the object has three-dimensional characteristics and that portions of the object appear to move relative to the viewer by the provision of a plurality of miniature distortion lenses and a magnification lens which are created in a compound lens system positioned between the two-dimensional object and a front of the display frame.

BRIEF DESCRIPTION OF THE DRAWINGS

A better understanding of the invention will be had with reference to the attached drawings wherein;

FIG. 3 is a cross-sectional view taken along line 3—3 of FIG. 1 showing an upper portion of the display housing being removed to allow insertion of an article to be displayed within the housing;

FIG. 4 is an enlarged cross-sectional view taken along line 4—4 of FIG. 1;

FIG. 5 is an enlarged cross-sectional view taken along 5—5 of FIG. 1;

FIG. 6 is a front elevational view of the magnifying lens of the present invention;

FIG. 7 is a rear elevational view of the distortion lens elements of the present invention;

DESCRIPTION OF THE PREFERRED EMBODIMENTS

Figure 1:
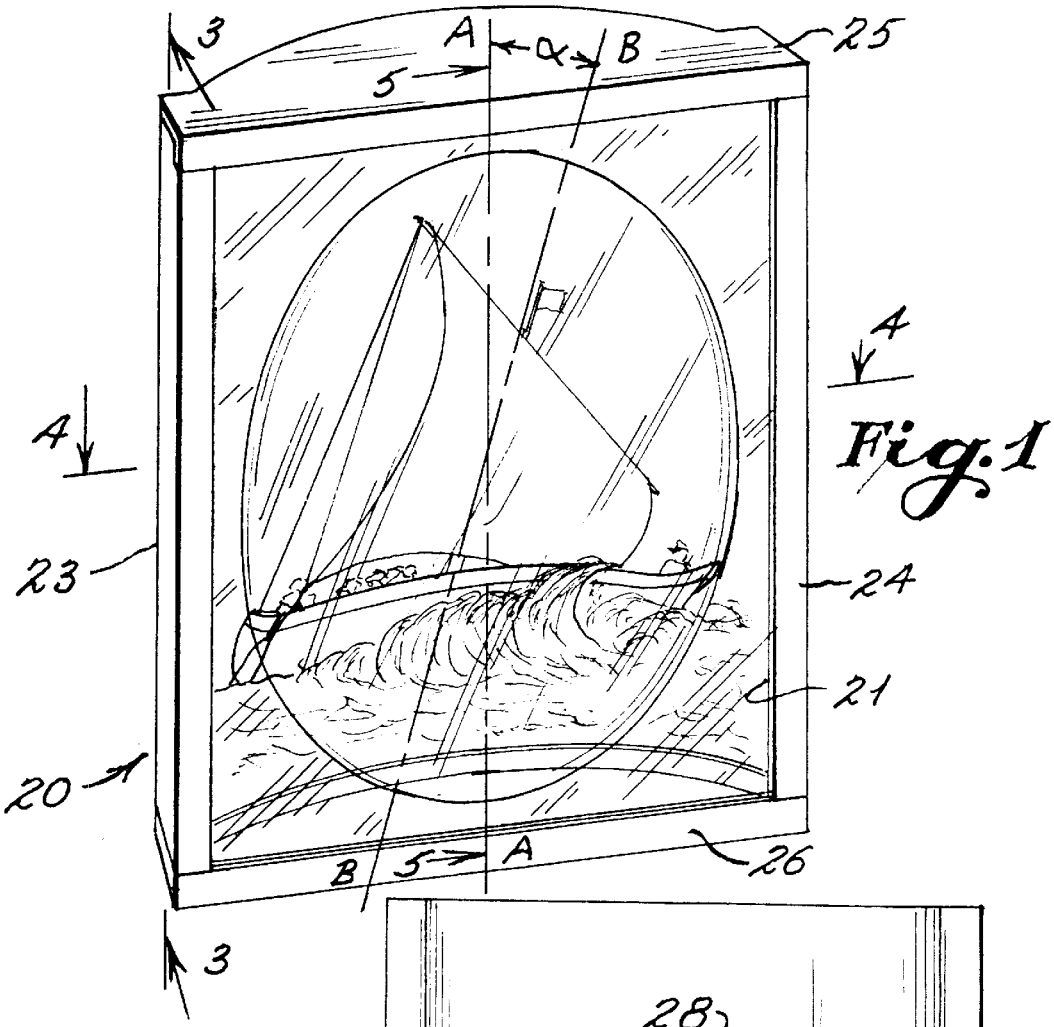
FIG. 1 is a front perspective view of a display assembly including a frame in which a two-dimensional object, such as a photograph, is displayed using the teachings of the present invention.

With continued reference to the drawing figures, the movement effect article display of the present invention is shown as being used to display a two-dimensional photograph "P" which may be of conventional size such as 4"×6", 5'×7", 8"×10", or 10"×12". It should be kept in mind that smaller displays and larger displays may be used in keeping with the teachings of the invention. Further, as opposed to photographs, different pictures, drawings, sketches, paintings, and other two-dimensional articles may be displayed using the teachings of the present invention.

With specific reference to FIG. 1, a frame housing 20 is shown having a front opening 21, a rear wall 22, opposite sides 23 and 24, a top closure 25 and a bottom 26. The display frame may be mounted to a wall surface by utilizing an appropriate hanger element 28 mounted to the rear thereof or, as an additional option, the frame can be free-standing on a horizontal surface by providing an appropriate support leg 30.

As shown in FIGS. 1–4, in the embodiment disclosed, the rear wall 22 of the frame housing is bowed rearwardly so as to provide a forwardly facing somewhat semi-cylindrical arcuate forward surface which is concave about a central vertical axis A—A of the frame. As opposed to providing an arcuate or curved wall, which extends outwardly relative to the sides 23 and 24 of the frame, the frame may be somewhat deeper between the front and rear walls and an internal arcuate article support surface may be provided within the frame spaced forwardly of the rear wall. As opposed to a surface wall, arcuate slots or guides may be provided.

In the present embodiment, elongated angular slots 32 and 33 are provided in the side walls 23 and 24 and serve to receive the elongated side edges of the photograph "P" or other article being displayed, as is shown in FIGS. 3 and 4. In this manner, the image of the photograph is arcuate relative to the vertical axis A—A in a vertical direction such that the center of the photograph is spaced farther from the front 21 of the frame than of the side edges. This mounting arrangement is preferred in order to create different depths of illusion. The arc of the picture simulates a portion of a viewing arc normally seen by an individual viewing the photograph. This feature combined with a unique compound lens system of the invention creates both distortion and magnification effects which result in a sense of movement of portions of the image of the photograph as well as a sense of three-dimensional characteristics.

Figure 2:
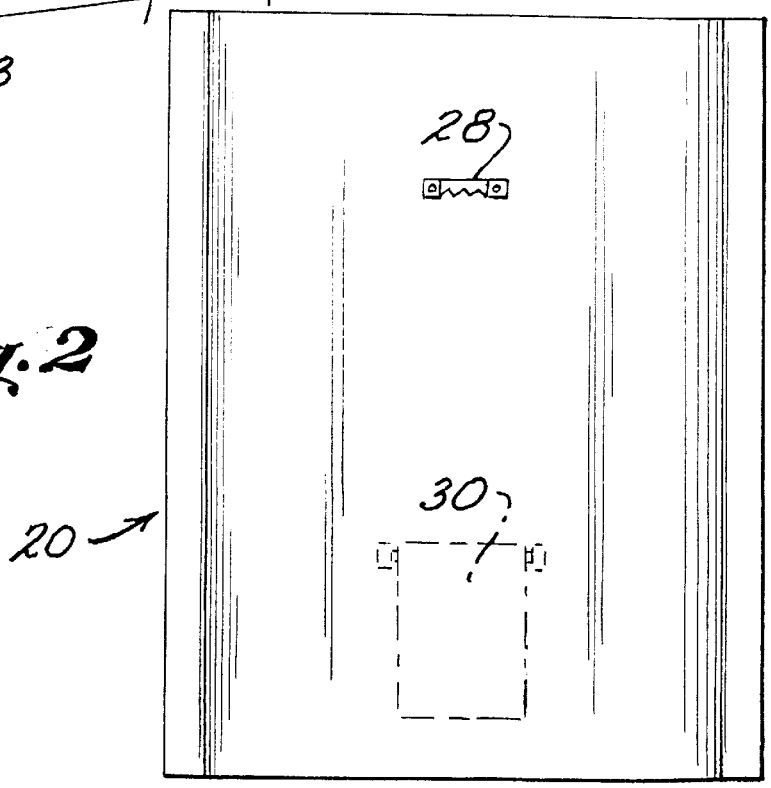
FIG. 2 is a rear elevational view of the display assembly of FIG. 1 showing that the assembly may be hung on a vertical wall surface, or in the alternative, used as a free-standing display on a horizontal surface.
Figure 8:
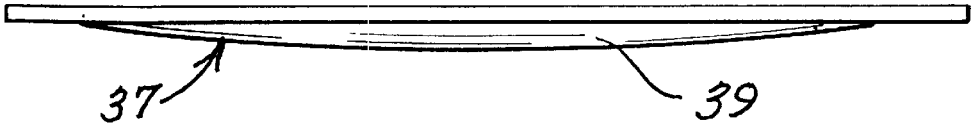
FIG. 8 is a view taken along line 8—8 of FIG. 6.

The compound lens system is shown in drawing FIGS. 1–3 as including a first distortion picture-glass element 36 and an outer magnification lens 37. As will be described in greater detail below, the picture glass 36 and the magnification lens 37 may be integrally formed into a single compound lens. Further, although the term "glass" is used with respect to the picture glass and the lens, both may be manufactured of either glass or plastic.

The picture glass 36 is formed in a semi-cylindrical arc which is complementary to the arc of the photograph to be displayed and includes end edges 36*a* and 36*b*, which are mounted with the slots 32 and 33 in the sides 23 and 24 of the frame housing. In the preferred embodiment, the inner surface 38 of the picture glass is textured so as to create vary slight changes in the thickness of the picture glass between its front and rear surface. As shown, the rear surface is generally mounted in abutting relationship with the front surface of the photograph or other article being displayed. The texturing is done to create non-uniform bump-like distortions 40 in the rear surface of the picture glass which are non-uniformly spaced and non-uniformly formed. These areas of distortion are preferably free-formed so that it is difficult for an individual to determine the exact outline of the pattern created by the distortions. The distortions actually form miniature lenses which are part of the otherwise generally plain surface of the picture glass. The distorted texturing causes distortions of small portions of the adjacent image of the photograph and actually create an effect of "movement" as the individual's eyes transverse from one portion of the image to another or when an individual moves relative to the display frame. It is preferred that the distortion lenses 40 be small compared to the underlying elements of the photograph or other article so that only minor portions of the underlying article are distorted. In this manner, the larger elements of the article being displayed will not be distorted, however, portions of individual sections of the article will be distorted. By way of example, naturally curved shapes, such as faces, bodies, foliage and fauna will have portions thereof which appear to be in motion within the larger elements of the object. This may create the effect of twitching of an eye, tightening of the lips or a slight movement of fingers or leaves of foliage when perceived by the viewer, especially as the viewer moves relative to the frame. In the example shown, the distortions which cover the waves against the image of a ship will actually appear to be in motion depending upon the manner in which an individual views or moves relative to the image of the photograph.

Although the distortions are preferably made so as to be oriented from the rear 38 of the picture glass 36, in some embodiments, distortions may be created on the opposite or both sides. However, when distortions are made on the forward side, light can be refracted before passing through to the image and being reflected back to the viewer, which is not preferred.

In the drawing figures, the distortions or miniature lenses 40 may be larger than they would be in practice, and thus are not to scale. It is preferred that they be smaller when compared to the underlying image, and in a real application, the density of such miniature distortion lenses may be much greater than shown in the drawing figures.

As shown in FIG. 3, either the upper portion 25 or lower portion 26 of the frame may be removable to allow a picture "P" to be selectively mounted within the opposing channels 32 and 33 and thereafter replaced to complete the continued appearance of the frame housing.

To further enhance the illusion of movement and to create a more realistic three-dimensional effect, the compound lenses of the present invention also include a forwardly mounted magnification lens 37. The magnification lens is shown as being mounted within forward elongated slots 42 and 44 provided in the sides 23 and 24 of the frame housing. The lens 37 is generally integrally formed having an elliptical magnification portion with a slight convex outer surface 39. The magnification portion of the lens or the entire lens itself, is oriented on a diagonally spaced angle a from the vertical axis A—A of the frame housing, as is shown in FIG. 1. Thus, the major axis B—B of the elliptical portion of the lens is not centered with the vertical axis A—A of the frame. Although the convex portion of the lens in FIG. 1 is shown as only extending in proximity to the upper, lower and side walls of the frame, in some embodiments, the entire viewing surface area of the frame is defined by the convex portion of the lens 37. Therefore, in preferred embodiments, the elliptically shaped lens should fill almost the entire rectangular space define by the front 21 of the frame.

The magnification created by the magnification lens should be very slight, and in this respect, it is preferred for sizes of frames discussed above that the lens only be thickened to approximate 1/64th of an inch or less at its center. This distortion or thickening could be greater or smaller for larger or smaller sizes of frames.

Figure 9:
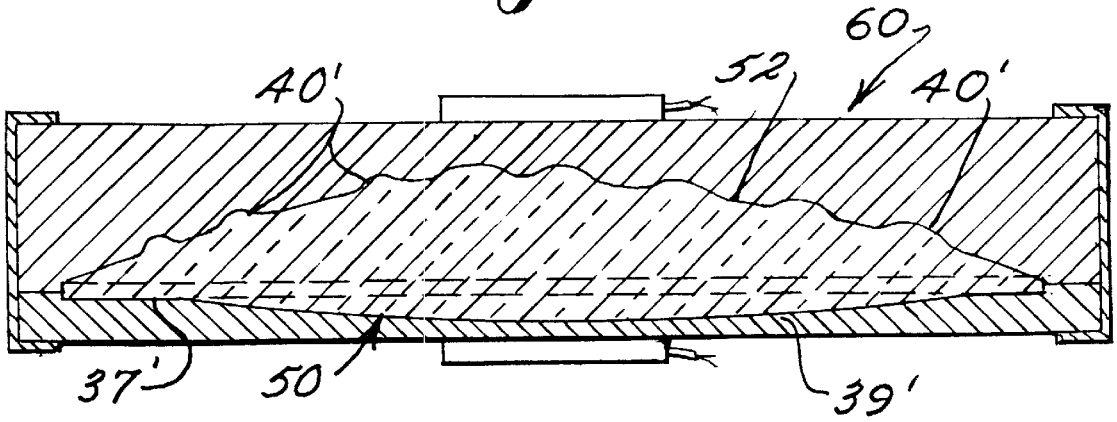
FIG. 9 is a side elevational view of an integral distortion and magnification lens in accordance of the teachings of the present invention.

The magnification and further distortion created by the magnification lens being mounted on a diagonal will exaggerate the perceived motion of the underlying image and will further create the illusion of the image being displayed in three dimension. The spacing between the picture glass 36 and the magnification lens 37 may be varied depending upon the size of the frame. Further, as previously discussed, the compound lens system may be formed as an integral unit. In this respect, as shown in FIG. 9, a single compound lens 50 is shown having a rear surface 52 having a plurality of distortions 40' therein, which form the miniature distortion lenses as described with respect to the distortions 40 of the separate picture glass 36. The front portion of the compound lens 50 includes the diagonal magnification lens 37' which is slightly convex towards the front of a frame housing, such as shown at 39'. Again, the compound lens may be formed of either a glass or a plastic. In the drawing figure, the lens is shown as being formed within a heating mold 60 in order to create the desired rearward distortion lenses and the forward magnification lens. In preferred embodiments, the rear surface is curved to match the curvature of an article to be displayed.

With the picture mounted within the frame housing as shown in FIGS. 1 and 3, the arc of the picture when added to the lens distortion and magnification effect of the compound lens system, creates an illusion that the picture is three dimensional and further causes portions of the image to appear to move. This is because the change in how a viewer must focus on the various portions of the image from one area of the picture to another.

Although the rear 22 of the frame housing of the invention shown in the drawings is somewhat curved, in practice, the surface can be generally flat and an interior portion of the frame housing provided with a support for retaining the picture glass and the photograph "P" is an arcuate configuration.

It should be further noted that, in some embodiments, a conventional non-glare glass or flat glass can be placed in the frame forwardly of the magnification lens 37. Although this structure is not shown in the drawings, lens 37 can be mounted closer to the picture glass 36 with an outer conventional glass being provided for the picture frame housing.

The frame may be constructed of wood, aluminum or other metal or plastic depending upon the desired end use. In some embodiments, the elements of the frame may be hinged together as opposed to snap fitted as shown in the drawing figures. Further, it is possible to incorporate into the frame housing other elements including lights, power circuit for a clock, or a thermometer or the like.

The foregoing description of the preferred embodiments of the invention has been presented to illustrate the principles of the invention and not to limit the invention to the particular embodiment illustrated. It is intended that the scope of the invention be defined by all of the embodiments encompassed within the following claims and their equivalents.

I claim:

1. A display assembly for creating a visual effect simulating motion and depth for an article to be displayed, the display assembly including, a frame, support means provided within said frame for supporting the article so that a surface thereof to be displayed is semi-cylindrically oriented along a central vertical axis of said frame and concavely oriented toward a front of said frame, a compound transparent lens assembly disposed forwardly of the said support means towards said front of said frame, said compound transparent lens assembly including a first picture glass element having a curvature which is generally semi-cylindrical in configuration being concave along said central vertical axis of said frame and having a convexly shaped rear surface oriented toward a rear of said frame, a plurality of miniature lenses formed in said rear surface of said picture glass, said plurality of miniature lenses being non-uniform with respect to one another and being in spaced relationship with respect to one another, and a magnification lens positioned forwardly of said picture glass, said magnification lens including an elliptical lens portion being generally convex relative to the front of said frame, whereby an image of the article to be displayed when viewed through said compound transparent lens assembly appears to have a three-dimensional characteristic with portions thereof being perceived to be in motion.

2. The display assembly of claim 1, in which said support means includes elongated slots in opposite sides of said frame in which edges of the article to be displayed can be selectively received.

3. The display assembly of claim 1 wherein said plurality of miniature lenses in said picture glass are formed as protrusions extending toward the rear of said frame.

4. The display assembly of claim 1 in which said elliptical lens portion includes a major axis which is oriented along an axis which is transverse with respect to said central vertical axis of said frame.

5. A display assembly for creating a visual effect simulating motion and depth for an article to be displayed, the assembly including, a frame, support means provided within said frame for supporting the article so that a surface thereof to be displayed is semi-cylindrically oriented along a central vertical axis of said frame and concavely oriented toward a front of said frame, a compound transparent lens disposed within said frame forwardly of said support means towards said front of said frame, said compound transparent lens including a plurality of miniature lenses formed by small distortions in an inner surface thereof which surface is oriented generally toward a rear of said frame and an outer convex magnification portion oriented toward said front of said frame, and said convex magnification portion of said compound transparent lens being generally elliptical and having a major axis oriented transverse to said cental vertical axis of said frame, whereby an image of the article to be displayed when viewed through said compound transparent lens appears to have a three-dimensional characteristic with portions thereof being perceived to be in motion.

6. The display assembly of claim 5 wherein said rear surface of said compound transparent lens is generally semi-cylindrical, being concave relative to said front of said frame.

* * * * *